US006234237B1

(12) United States Patent
Skands

(10) Patent No.: US 6,234,237 B1
(45) Date of Patent: May 22, 2001

(54) SYSTEM FOR SUSPENSION OF SOUND-ABSORBING ELEMENTS AND A METHOD FOR CLEANING OF THE ELEMENTS

(75) Inventor: Morten Skands, Frederiksberg (DK)

(73) Assignee: HM Akustik A/S, Hvidovre (DE)

( * ) Notice: Subject to any disclaimer, the term of this patent is extended or adjusted under 35 U.S.C. 154(b) by 0 days.

(21) Appl. No.: 09/341,278

(22) PCT Filed: Jan. 14, 1998

(86) PCT No.: PCT/DK98/00018

§ 371 Date: Jul. 7, 1999

§ 102(e) Date: Jul. 7, 1999

(87) PCT Pub. No.: WO98/31886

PCT Pub. Date: Jul. 23, 1998

(30) Foreign Application Priority Data

Jan. 15, 1997 (DK) ..... 0049/97

(51) Int. Cl.[7] ..... E05D 15/06

(52) U.S. Cl. ..... 160/196.1; 160/199; 160/214; 49/199

(58) Field of Search ..... 160/84, 40, 32, 160/196.1, 199, 214, 344; 49/127, 199; 52/243.1, 238.1

(56) References Cited

U.S. PATENT DOCUMENTS

| | | | | |
|---|---|---|---|---|
| 1,382,365 | * | 6/1921 | Kern | 160/196.1 X |
| 1,960,860 | * | 5/1934 | Allen | 160/196.1 X |
| 2,915,115 | * | 12/1959 | Reynolds | 160/196.1 X |
| 3,003,551 | * | 10/1961 | Ferris | 160/196.1 |
| 3,450,185 | * | 6/1969 | Holloway | 160/196.1 X |
| 4,254,582 | * | 3/1981 | McGee | 49/199 |
| 4,569,164 | * | 2/1986 | Dickson | 160/196.1 X |
| 4,961,454 | * | 10/1990 | Reilly, Jr. et al. | 160/344 |
| 5,165,142 | * | 11/1992 | Pilsbury | 160/196.1 X |
| 5,406,761 | * | 4/1995 | Hobbiebrunken et al. | 52/243.1 |
| 5,667,039 | * | 9/1997 | Spiess | 187/334 |
| 5,890,323 | * | 4/1999 | Errato | 160/196.1 X |
| 5,967,160 | * | 10/1999 | Rochette et al. | 160/196.1 X |

FOREIGN PATENT DOCUMENTS

| | | |
|---|---|---|
| 3048214 | 7/1982 | (DE) . |
| 155195 | 2/1989 | (DK) . |
| 2260184 | 4/1993 | (GB) . |

* cited by examiner

*Primary Examiner*—Daniel P. Stodola
*Assistant Examiner*—Bruce A. Lev
(74) *Attorney, Agent, or Firm*—Cooper & Dunham LLP; Donald S. Dowden

(57) ABSTRACT

A system for suspension in elongated bearing rails (1) of plate-shaped sound-absorbing elements (2) in such a manner that the elements, if desired, can be taken down for cleaning and disinfecting purposes. Sound-absorbing elements (2) are suspended in the bearing rails (1) by wheels (3). In this manner each plate-shaped element (2) can be moved along the carrier rail (1) and taken down at the end of the rail for cleaning and disinfecting purposes, and particular scaffoldings at various locations inside the factory building are no longer required.

4 Claims, 1 Drawing Sheet

SYSTEM FOR SUSPENSION OF SOUND-ABSORBING ELEMENTS AND A METHOD FOR CLEANING OF THE ELEMENTS

TECHNICAL FIELD

The invention relates to a system for suspension in elongated bearing rails of preferably plate-shaped sound-absorbing elements of a height significantly smaller than the height of the walls in the room in question in such a manner that said elements, if desired, can be taken down for cleaning and disinfecting purposes, where said sound-absorbing elements are suspended in the bearing rails for instance by means of rollers, such as wheels.

BACKGROUND ART

It is important especially inside factory buildings that the sound-absorbing elements are cleaned and disinfected at regular intervals.

German Offenlegungsschrift No. 3,048,214 discloses a suspension of sound-absorbing mats with a drain at the lower edge of the mats. The drain catches the wash water when the sound-absorbing elements are cleaned by way of a spraying thereon of detergent from stationary spray nozzles placed next to each mat.

German Offenlegungsschrift No. 4,220,492 discloses sound-attenuating plates to be suspended in large rooms or buildings. Each plate comprises a core of sound-absorbing fibre material covered on the outer side of a porous lining. The plate elements are suspended in slides by means of hooks, and these slides can be displaced along a T-shaped rail. The slide and the T-shaped rail are, however, subjected to some friction.

BRIEF DESCRIPTION OF THE INVENTION

The object of the invention is to provide a system for suspension of sound-absorbing plate-shaped elements, whereby said elements are easier to take down especially for cleaning purposes than previously.

A suspension system of the above type is according to the invention characterised by the sound-absorbing elements communicating with one another in such a manner that they can be displaced like a train of carriages. As a result, it is particularly easy to mount and subsequently take down the sound-absorbing elements one by one from one and the same place.

In this manner each plate-shaped element can be moved along the carrier means and taken down at the end of said carrier means for cleaning and disinfecting purposes with the result that particular scaffoldings or the like at various locations inside the factory building are no longer required.

Furthermore, the sound-absorbing element may according to the invention be suspended in two wheels arranged at each side of the rail, a space applying between the wheels for the suspension means of the carrier rail extending to the ceiling structure.

Moreover, the sound-absorbing elements may according to the invention be interconnected in such a manner that they can be displaced like a "train of carriages" with the result that the taking down of each element is facilitated.

The invention relates also to a method of cleaning and disinfecting plate-shaped sound-absorbing elements suspended in elongated carrier rails by means of rollers, such as wheels.

The method is according to the invention characterised by the sound-absorbing elements being moved along the carrier rail so as at the end thereof to be taken down one by one for cleaning and disinfecting purposes.

BRIEF DESCRIPTION OF THE DRAWINGS

The invention is explained in greater detail below with reference to the accompanying drawings, in which.

BEST MODE FOR CARRYING OUT THE INVENTION

The industry has become more and more environment-conscious inter alia with the effect that new provisions have been introduced concerning suppression of baffle. These provisions apply also to areas presented to high sanitary requirements, and especially to the food industry, such as dairies and slaughterhouses. The dairies involve many pipes, and accordingly it can be difficult to take down suspended sound-absorbing elements in form of baffles for cleaning purposes.

Figure 1:
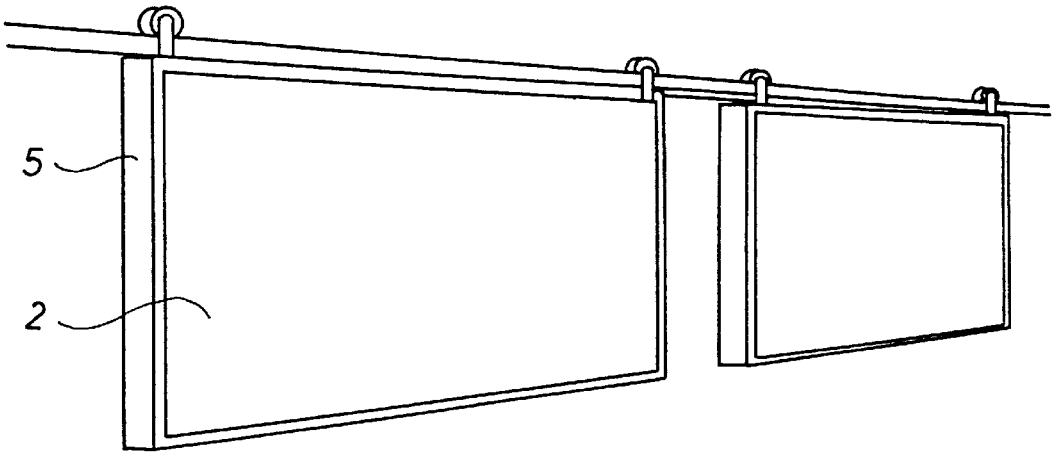
FIG. 1 illustrates a system for suspension in elongated carrier rails of sound-absorbing elements by means of wheels.
Figure 2:
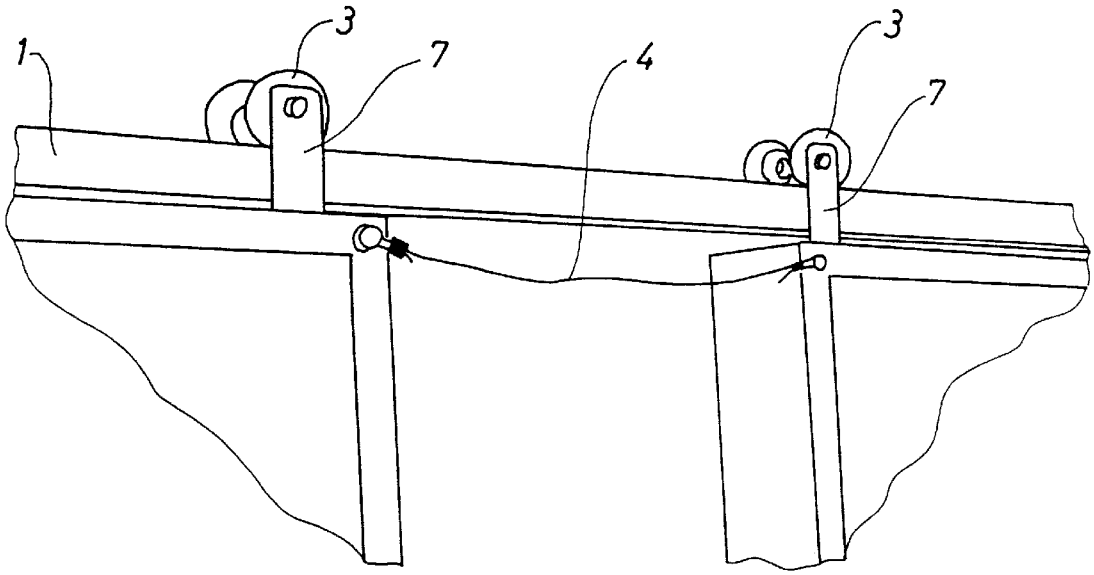
FIG. 2 illustrates on a larger scale an example of a wheel suspension in form of a pair of wheels.

These problems have according to the invention been set right by means of the system illustrated in FIG. 1 for suspension of plate-shaped sound-absorbing baffle elements. This system comprises a plurality of elongated carrier means in form of carrier rails 1. The carrier rails 1 are preferably formed by closed profiles of a rectangular cross section. An advantage of such carrier rails is that they are easy to clean. Then the baffle elements 2 are suspended in wheels 3 in such a manner that they can be easily moved along the rail 1 and optionally taken down at the end of said rail so as to be washed on the outer side. The wheels 3 are preferably arranged in pairs at regular intervals with one on each side of the carrier rail 1. A space is provided between the wheels 3 for the suspension means of the carrier rail 1 and the remaining ceiling structure, said suspension means being secured to the top side of the carrier rail 1 at the center of said carrier rail.

The above baffle elements 2 can optionally be interconnected in such a manner that they can be taken down one by one for cleaning and disinfecting purposes.

As an alternative, the baffle elements 2 can be moved through a washing tunnel accommodated in connection with the rail system.

In general it is a question of elongated carrier means, and these carrier means need not necessarily be formed by rails, but can also be formed by cables.

The baffle elements 2 are preferably interconnected by means of wire elements 4 in such a manner that they can be displaced like a "train of carriages". As a result, it is very easy to take down the baffle elements 2 one by one from one and the same place.

The carrier rails 1 are not necessarily horizontal, but can also be slightly inclined. The baffle elements 2 need not extend in the longitudinal direction of each rail 1 either, but can be angularly positioned relative thereto, optionally with adjustment possibilities in such a manner that it is possible to provide for particularly noisy articles. Each baffle element 2 is not necessarily suspended in only one rail, but can as an alternative be suspended in several rails.

Each baffle element 2 can optionally be provided with separate driving means in form of a small electromotor. This electromotor is able to drive the wheels in such a manner that the baffle elements 2 are automatically carried through the washing tunnel without necessitating a taking down. The electromotors can optionally be radio-controlled.

Each baffle element 2 presents the dimensions 1,200 times 600 times 80 mm. The sound-absorbing material is made of 40 mm thick plates of mineral wool, where a glass splinter is glued onto both sides of said plates. On the side facing outwards of the plate of mineral wool, the glass splinter is coated with a paint preventing fluid from penetrating into the mineral wool in connection with the washing by means of water and detergents. The plates of mineral wool is surrounded by a frame 5 of stainless steel. This steel frame 5 is made of a stainless steel plate of a thickness of approximately 0.6 mm bent into a U-profile. The latter U-profile fixes the two plates of mineral wool and protects the edges of said plates. A silicone joint is inserted between the glass splinter and the sound-absorbing plate and the frame 5 so as to provide a seal against penetrating fluid. A number of upward angle pieces 7 are secured to the upper portion of the frame 5, the wheels 3 being secured to said angle pieces.

What is claimed is:

1. A method of exchanging plate-shaped sound-absorbing elements suspended in a room comprising the steps of:

selecting the elements to have a height significantly less than the height of the room;

suspending the elements from elongated carrier means;

connecting the elements together so that movement of one element along the elongated carrier means pulls another element along behind it;

moving a train of connected elements so that they are brought one-by-one to a taking down station;

taking the elements down one-by-one at said station for exchanging with cleaned and disinfected elements; and suspending said elements again from the elongated carrier means.

2. A method according to claim 1 comprising the step of providing rollers on the elongated carrier means for suspending the sound-absorbing elements.

3. A method according to claim 1 comprising the step of providing each sound-absorbing element with separate driving means in the form of radio-controlled electromotors in such a manner that the elements automatically can be carried through a washing tunnel, without intervention by an operator.

4. A method according to claim 1 comprising the step of providing at least one bearing rail forming at least a part of the elongated carrier means.

* * * * *